US005853140A

United States Patent [19]

Biagiotti

[11] Patent Number: 5,853,140

[45] Date of Patent: Dec. 29, 1998

[54] RE-REELING MACHINE FOR ROLLS OF BAND-SHAPED MATERIAL, WITH CONTROL OF THE INTRODUCTION OF THE WINDING CORE

[75] Inventor: Guglielmo Biagiotti, Lucca, Italy

[73] Assignee: Fabio Perini S.p.A., Lucca, Italy

[21] Appl. No.: 930,770

[22] PCT Filed: Apr. 10, 1996

[86] PCT No.: PCT/IT96/00068

§ 371 Date: Oct. 8, 1997

§ 102(e) Date: Oct. 8, 1997

[87] PCT Pub. No.: WO96/32350

PCT Pub. Date: Oct. 17, 1996

[30] Foreign Application Priority Data

Apr. 14, 1995 [IT] Italy ..... FI9500069

[51] Int. Cl.[6] ..... B65H 18/16

[52] U.S. Cl. ..... 242/534; 242/533.1; 242/542.1

[58] Field of Search ..... 242/533, 533.1, 242/534, 541, 541.5, 542, 542.1, 542.2, 542.3

[56] References Cited

U.S. PATENT DOCUMENTS

| | | | |
|---|---|---|---|
| 3,727,854 | 4/1973 | Grotzbach | 242/533.1 |
| 4,056,918 | 11/1977 | Matsumoto | 242/533.1 |
| 4,266,735 | 5/1981 | Leanna et al. . | |
| 4,327,877 | 5/1982 | Perini . | |
| 4,487,377 | 12/1984 | Perini . | |
| 4,723,724 | 2/1988 | Bradley . | |
| 4,828,195 | 5/1989 | Hertel et al. . | |
| 4,909,452 | 3/1990 | Hertel et al. | 242/541.5 |
| 5,031,850 | 7/1991 | Biagotti | 242/542 |
| 5,137,225 | 8/1992 | Buxton | 242/542 |
| 5,248,106 | 9/1993 | Biagiotti . | |
| 5,249,756 | 10/1993 | Biagiotti . | |
| 5,368,252 | 11/1994 | Biagiotti | 242/542.1 |
| 5,370,335 | 12/1994 | Vigneau | 242/542.1 |
| 5,421,536 | 6/1995 | Hertel et al. | 242/526.1 |
| 5,505,402 | 4/1996 | Vigneau | 242/527.1 |
| 5,505,405 | 4/1996 | Vigneau | 242/542.1 |

FOREIGN PATENT DOCUMENTS

| | | |
|---|---|---|
| 58-74446 | 5/1983 | Japan . |
| 60-171958 | 9/1985 | Japan . |
| 5-25744 | 2/1993 | Japan . |
| 6-64800 | 3/1994 | Japan . |
| WO 94/21545 | 9/1994 | WIPO . |

*Primary Examiner*—John P. Darling
*Attorney, Agent, or Firm*—Breiner & Breiner

[57] ABSTRACT

A peripheral re-reeling machine including a first winding roller around which a band-shaped material to be wound is guided; a second winding roller, there being defined between the first and second winding rollers a throat into which winding cores are introduced in succession; a feeder for successively introducing cores into the throat, and control apparatus for bringing about, on each insertion of a new winding core, a variation in the winding conditions for insertion of a new core. A sensor associated with the throat is provided which detects passage of a core at a predetermined point and emits a signal on the passage of the core, with cyclical operational variation in the winding conditions occurring based on the signal.

18 Claims, 5 Drawing Sheets

Fig. 8
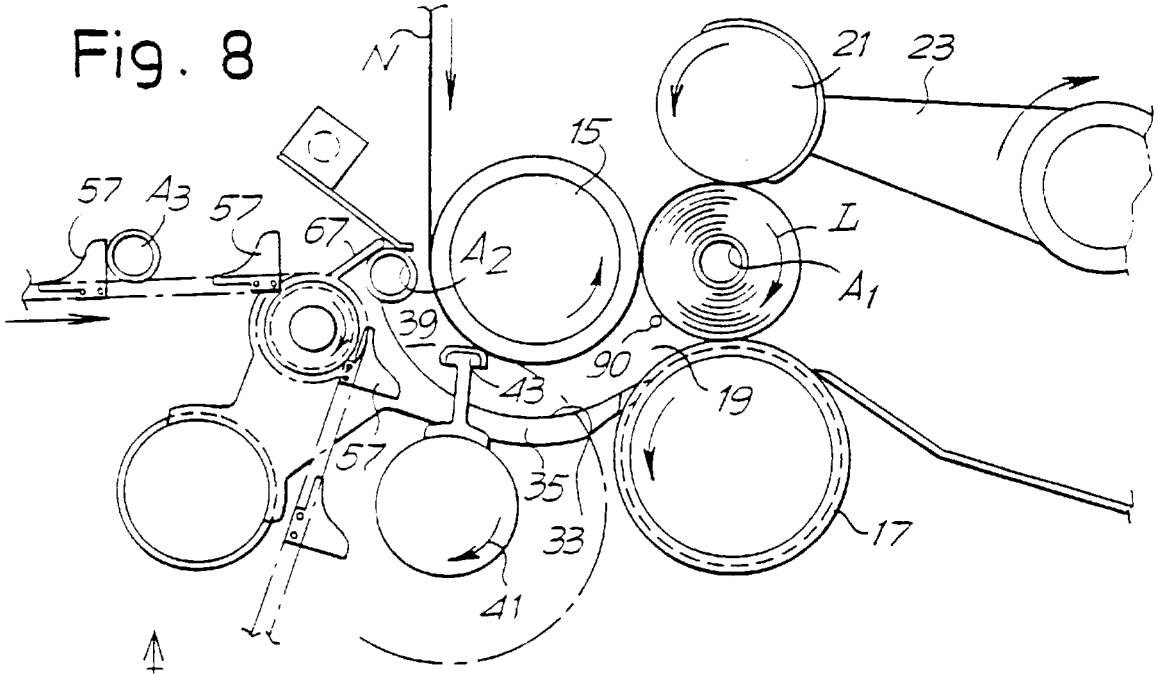
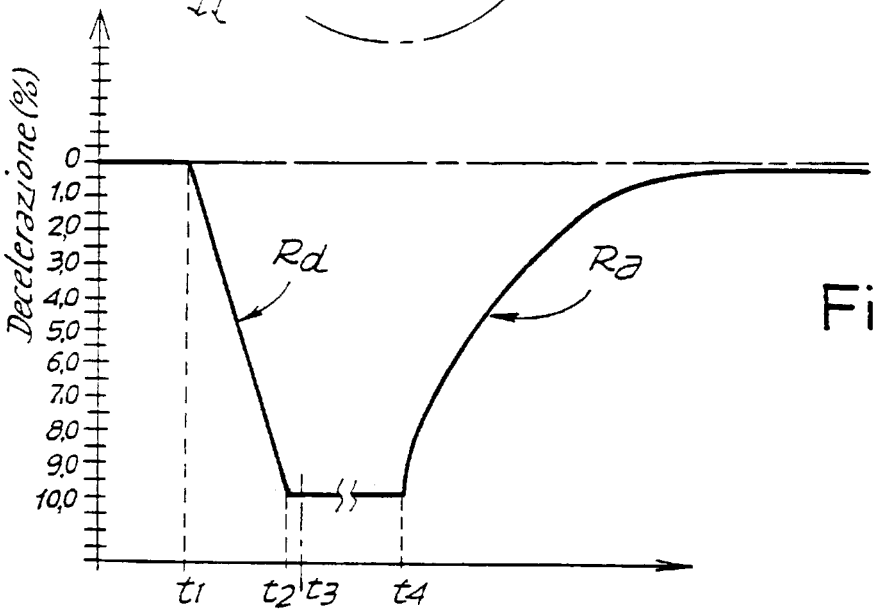
Fig. 9
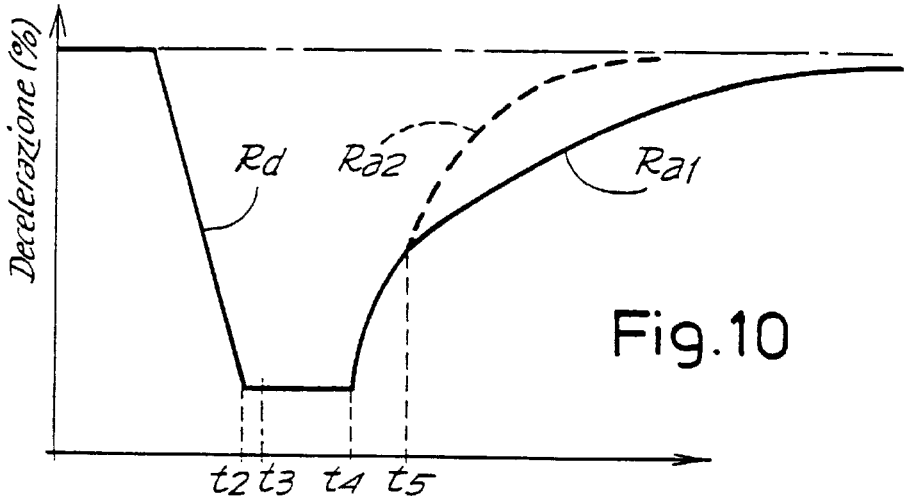
Fig. 10

RE-REELING MACHINE FOR ROLLS OF BAND-SHAPED MATERIAL, WITH CONTROL OF THE INTRODUCTION OF THE WINDING CORE

DESCRIPTION

1. Technical field

The present invention relates to an improvement to a peripheral re-reeling machine of the type comprising a first winding roller, around which the band-shaped material to be wound is guided, a second winding roller defining, with the first winding roller, a throat into which the winding cores are introduced in succession, means for introducing the cores into said throat and means of control for bringing about, at the end of winding of a roll, a cyclical variation in the winding conditions for control of the advance of the new core (if appropriate with the first turns of material wound around it) through the throat.

Re-reeling machines of this type, commonly known as automatic peripheral re-reeling machines, are used for example in the paper conversion industry to form continuously logs or rolls of wound paper starting from bobbins of large diameter. The logs are successively cut perpendicularly to their own axis to produce small rolls of toilet paper, all-purpose towels and similar products of desired height.

The invention also relates to an improvement to a method for the production of logs of band-shaped material wound on tubular cores comprising the phases of: providing a first winding roller around which the band-shaped material is guided; providing a second winding roller, a throat being defined between the first and the second winding roller for the passage of the winding cores; at the end of the winding of a roll, varying temporarily the conditions of winding to introduce a new core through said throat.

2. State of the Art

Among the numerous patents relating to re-reeling machines of this type, U.S. Pat. Nos. 4,327,877, 4,487,377, 4,723,724, 4,828,195, 5,248,106, 5,249,756, British patent no. 2,105,688, European patent no. 0 498 039 and more recently the international publication WO 94/21545 and the Italian patent application MI93A 1013 stand out, among others.

In peripheral re-reeling machines of this type, the band-shaped material is fed continuously and at an essentially constant speed of the order of 400–700 m/min and up to 1000 m/min in the most advanced machines. There is inserted into the re-reeling machine a tubular cardboard core, on which, in the span of time of 1–3 seconds, the log or roll is formed. This has then to be discharged from the winding zone to make space for a new core on which a new log is being formed. The operations of insertion of the core are effected in various ways but typically with a temporary variation of the winding conditions. In general terms, the passage of the core through the throat defined by the two winding rollers takes place by means of a difference between the peripheral speeds of the two winding rollers. The difference in speed can be different according to the methods of functioning of the machine and can be due to a temporary variation, comprised for example between 1% and 20% in relation to the speed of advance of the band-shaped material. Once the core has passed through the throat, or while it is passing through it, the speed of rotation of the second winding roller is gradually increased again to the operating speed, close or equal to the speed of the first winding roller. In this case, therefore, the winding condition which is varied is the peripheral speed of the winding roller.

The deceleration/re-acceleration cycle of the second winding roller and that of the insertion of the core in contact with the band-shaped material are synchronized with one another. Thus the re-acceleration of the second winding roller starts when the core has theoretically reached a given predetermined position in relation to the winding rollers. This synchrony is obtained by making reference to the angular position of the first winding roller, or of another roller for conveying the band-shaped material, which has a given position in relation to the band-shaped material.

In some machines, the insertion of the core takes place still by difference of speed between the first and the second winding roller, but the condition of winding which is varied is no longer the peripheral speed of the second winding roller (which remains constant) but rather the interdistance between said first and said second roller. Essentially, the dimension of the throat is temporarily and cyclically varied during the passage of the core through the throat itself. The passage of the core is due to the difference in peripheral speed between the two rollers which is limited but constant in time.

When the core is inserted into the winding zone and enters into contact with the band-shaped material which is guided around the first winding roller, or in any case with a member rotating at a speed proportional to the speed of advance of the band-shaped material, it is suddenly accelerated angularly until it assumes a peripheral speed equal to the speed of advance of the band-shaped material. Contact can take place simultaneously with the two winding rollers defining the throat, or with the first winding roller and a contrast surface. In any case, the core tends to slide in relation to the band-shaped material and the winding roller with which it comes into contact.

It has now been learned that this sliding is not constant but can vary from core to core, with the consequence that, even taking into account a typical sliding in synchronization phase of the various members of the machine, it will be possible in actual functioning fro each core to slide by a greater or lesser extent in relation to the sliding initially assumed as a reference. This means that the re-acceleration phase of the second winding roller may be early or late in relation to the position of the core in the throat between the two winding rollers. If the core slides more than expected when it enters into contact with the winding roller, it is late in relation to the gradient of re-acceleration of the second winding roller, with the consequence that it has difficulty in leaving the throat. If, on the other hand, the sliding is less than expected, the core is early in relation to the gradient of re-acceleration of the second winding roller and can pass through the throat too rapidly with the risk of not being perfectly controlled.

There is a similar disadvantage when the peripheral speed of the second winding roller is kept constant and the interdistance between the two rollers is varied. In this case also, the uncertainty of the extent of the actual sliding of the core in the insertion phase may involve a dephasing between actual position of the core and opening-apart movement of the two winding rollers. Consequently, the core which is late in relation to the theoretical position can be too compressed while earliness involves the risk of a loss of control of the core.

The aim of the present invention is that of eliminating the disadvantages illustrated above.

SUMMARY OF THE INVENTION

According to the invention, there is provided in a peripheral re-reeling machine of the type indicated above a sensor means associated with said throat, which detects the passage of the core from a predetermined position and emits a signal on the passage of said core. The means which bring about the cyclical variation of the winding conditions are phased with the signal emitted by said sensor and therefore with the actual position of the core. That is to say these bring about said variation at a moment which is determined according to the moment at which said signal is generated.

When the winding condition which is temporarily varied is represented by the peripheral velocity of the second winding roller, it is possible to make provision for the signal to be synchronized with the start point of the re-acceleration gradient of the second winding roller. In this way, the re-acceleration gradient of the second winding roller is always correctly synchronized with the actual position of the core in the machine and not with its theoretical position. Whatever the extent of the sliding of the core in the introduction phase, the start of the re-acceleration of the second winding roller is determined from time to time when the core is actually in the correct position.

On the other hand, it is also possible to make provision for the re-acceleration gradient to start at a fixed moment and for the time intervening (or the quantity of hand-shaped material which passes) between said moment and the moment of emission of the signal to bring about a successive adaptation of the slope of the residual re-acceleration curve from the moment of emission of the signal (or from a successive moment) on until the operating speed is reached.

The advantages which can be obtained with a control system of this type are particularly relevant in a case in which the core undergoes two different and successive angular accelerations (such as for example in WO 94/21545).

When the core is inserted contemporaneously with a variation of the axle distance between the first and the second winding roller, the signal emitted by the sensor can condition the relative movement between the two rollers according to a similar concept.

It is clear that there may already be wound on the core which is passing through the throat a more or less plentiful quantity of band-shaped material, according to how the start of the winding takes place. Therefore, "core" must also be understood in this context as a core on which a certain quantity of band-shaped material is possibly already wound.

The sensor means can be of various types. Currently preferred is a sensor of optical type, with an emitter arranged on one side of the throat and a receiver arranged on the opposite side, with the core passing between emitter and receiver. In this manner, there is a double obscuring signal since the core is a hollow tube. Alternatively, it is possible to utilize the first and second obscuring signal to condition the procedure of variation of the winding conditions. Other possibilities are not excluded, with both optical sensors and sensors of other types. For example, it is possible to arrange a sensor with emitter and receiver accommodated in a groove of the second winding roller in the region of the throat between the winding rollers. In such a case, the light beam emitted by the emitter is reflected by the surface of the first winding roller or by the band-shaped material guided on it. The receiver receives the reflected or diffused light energy. The passage of the tubular core (normally of dark colour and therefore absorbent) intercepts the beam and obscures the receiver. Sensors of electromechanical or other type can also be used.

The position of the sensor in relation to the throat of the re-reeling machine can advantageously be adjustable. As an alternative to or in combination with this, it is possible to provide for the means of control of the variation in speed of the second winding roller being equipped with a programmable delay circuit which makes it possible to delay the start of the re-acceleration gradient by a predeterminable amount in relation to the signal emitted by the sensor means. On the other hand, adjustment of the position of the sensor can be provided.

Further advantageous characteristics of the machine and of the device according to the invention are indicated in the attached claims.

It is possible to apply the same concepts explained above to leaving out of consideration how the variation of peripheral speed of the winding roller is obtained. This can, in fact, be due to a variation of the angular speed or to a variation of the radius of the winding roller, if appropriate in combination with a variation of the axle distance between the winding rollers, as described for example in M193A001768.

BRIEF DESCRIPTION OF THE DRAWINGS

The invention will be better understood by following the description and the attached drawing which shows a non-limiting exemplary embodiment of the invention itself. In the drawing.

FIGS. 2 to 8 show the various phases of functioning of the re-reeling machine in a winding cycle;

FIG. 9 shows a diagram of the speed of the second winding roller, according to the first method of control, and FIG. 10 shows a diagram of the speed of the second winding roller in a different method of control.

DETAILED DESCRIPTION OF AN EMBODIMENT

The invention will be described below by application to a re-reeling machine of the type described in WO 94/21545, the content of which is incorporated in the present description. However, it is intended that the same principles can be applied to other peripheral re-reeling machines which have a second winding roller actuated at variable speed.

Figure 1:
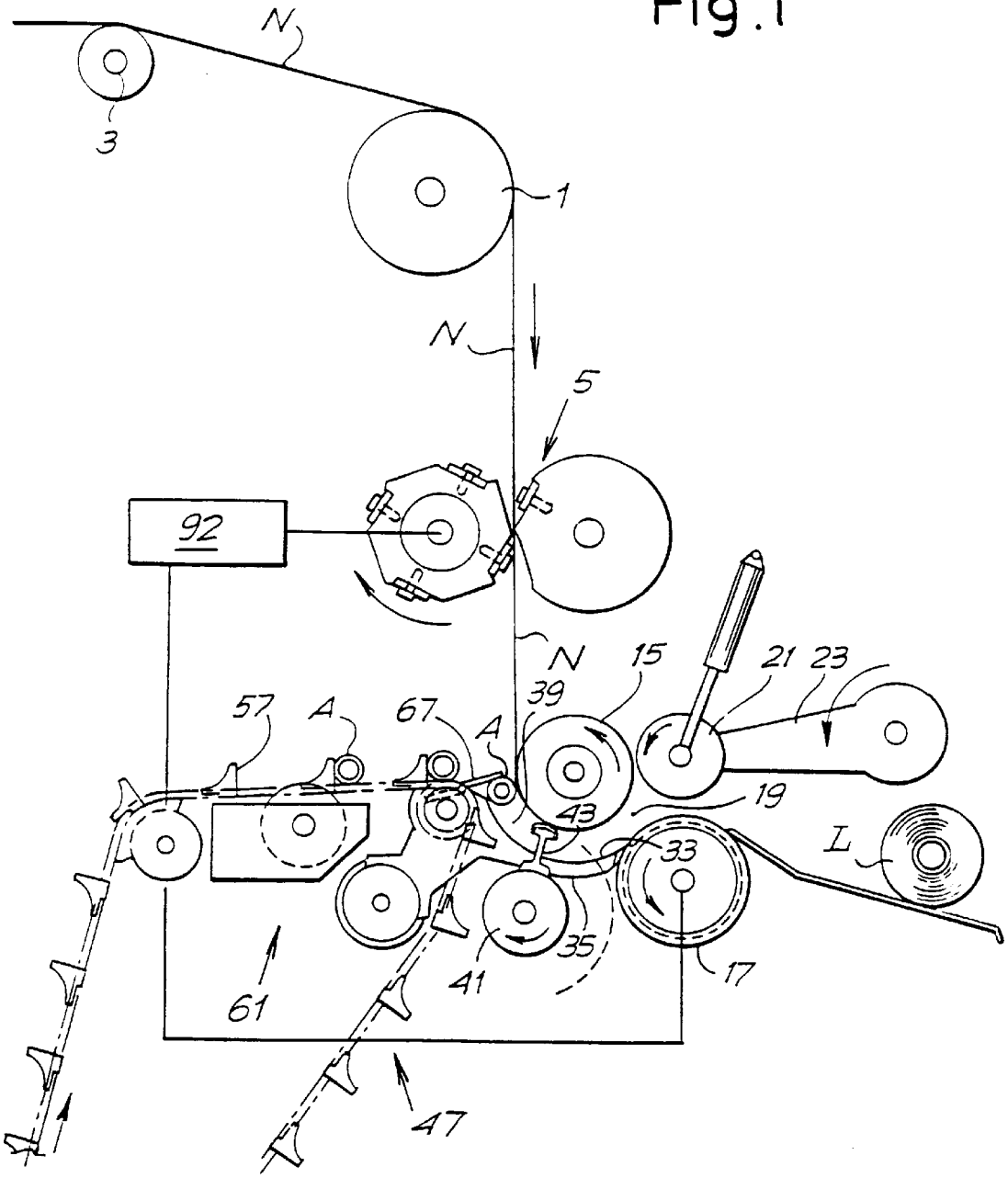
FIG. 1 shows a lateral view of a peripheral re-reeling machine in which the invention can be applied.

With initial reference to FIG. 1, feed and guide rollers for the band-shaped material N are indicated by 1 and 3. A perforator group is generally indicated by 5. Arranged downstream of the perforator group 5 is a first winding roller 15, around which the band-shaped material is guided, and a second winding roller 17, rotating in the same direction as the roller 15. Defined between the two rollers 15 and 17 is a throat 19 through which the band-shaped material N passes. 21 indicates a third winding roller, borne by an oscillating arm 23 to follow the growth of the roll or log L being formed and to allow its discharge when winding is completed.

Arranged upstream of the throat 19 is a surface 33 for rolling of the core A inserted at the start of each operating cycle. A rotating element 41 positioned below the surface 33 bears means 43 of interruption of the band-shaped material N. The form and method of functioning of the means 43 are described in WO 94/21545, to which reference can be made for further details.

The cores A are introduced into the channel 39 defined between the winding roller 15 and the surface 33 by a feeder 67 which takes them from a conveyor 47 equipped with pushers 57 and with which a glue distributor 61 of a type known per se is associated.

Figure 2:
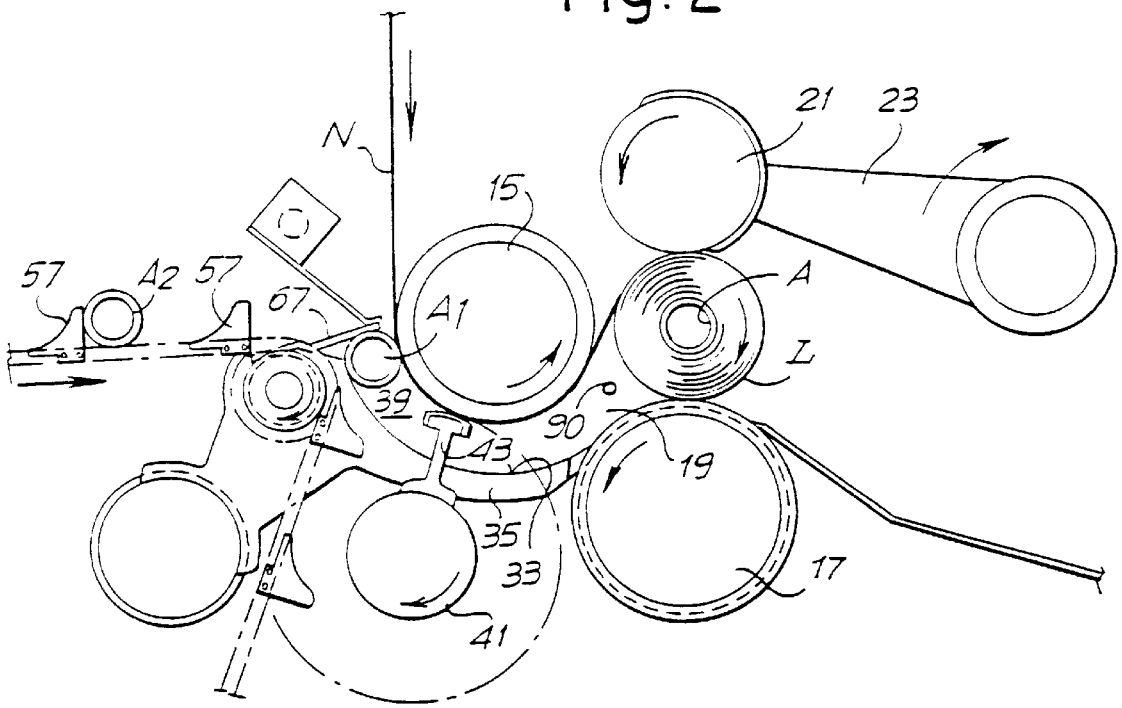
Figure 3:
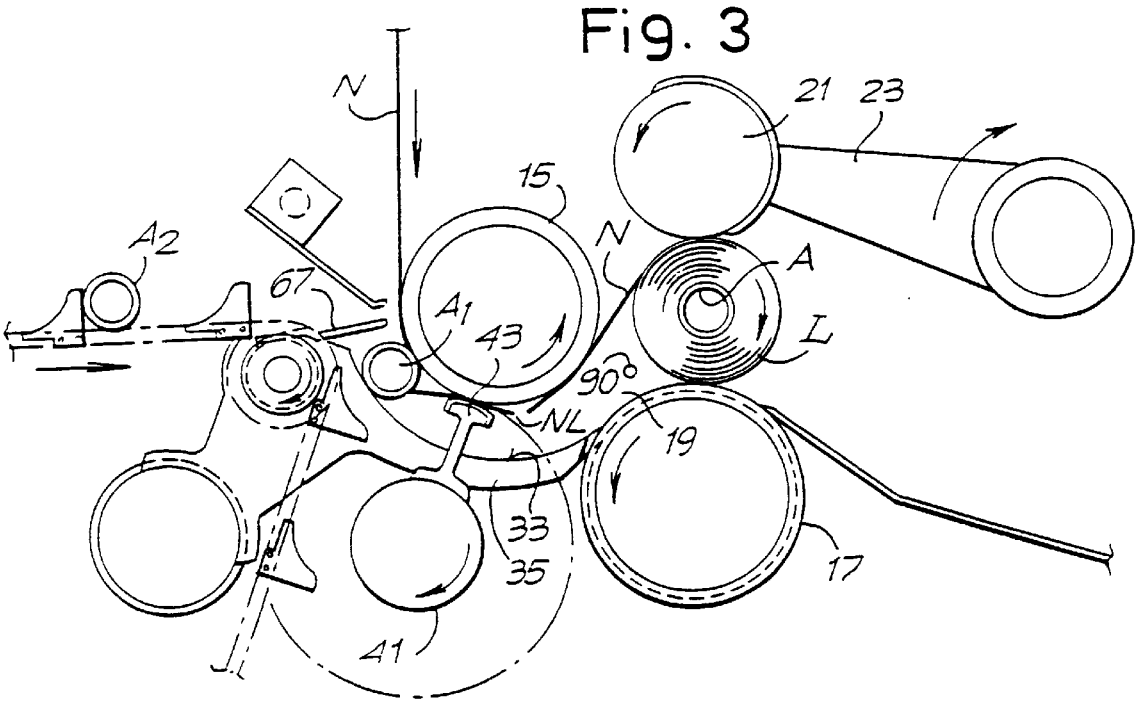
Figure 4:
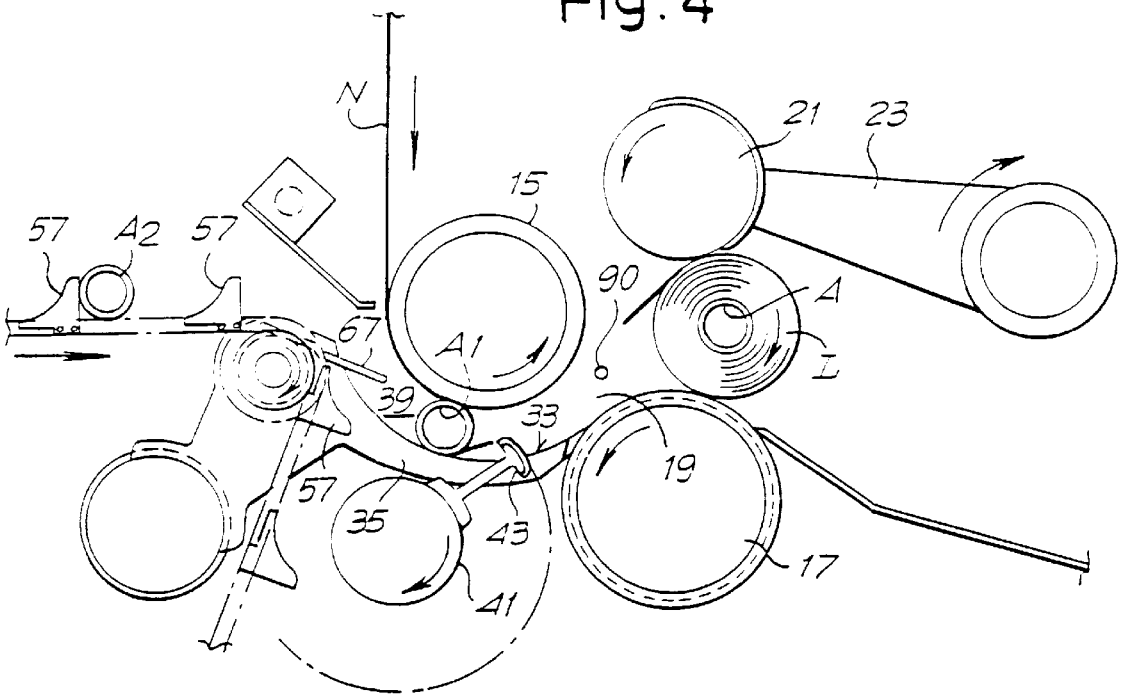
Figure 5:
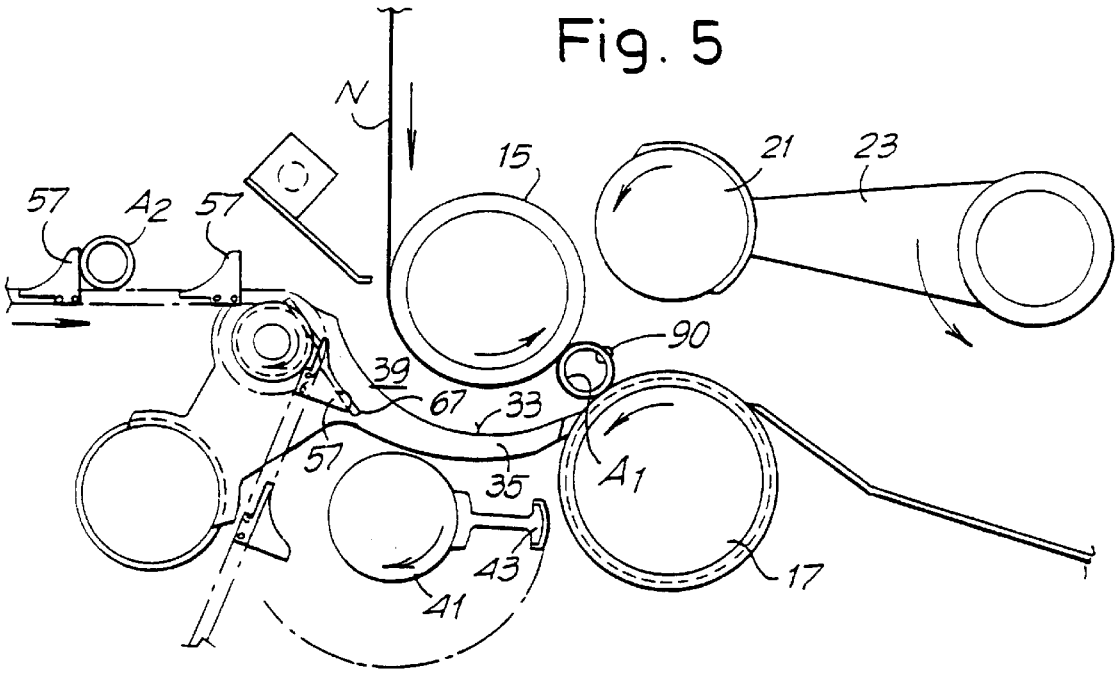
Figure 6:
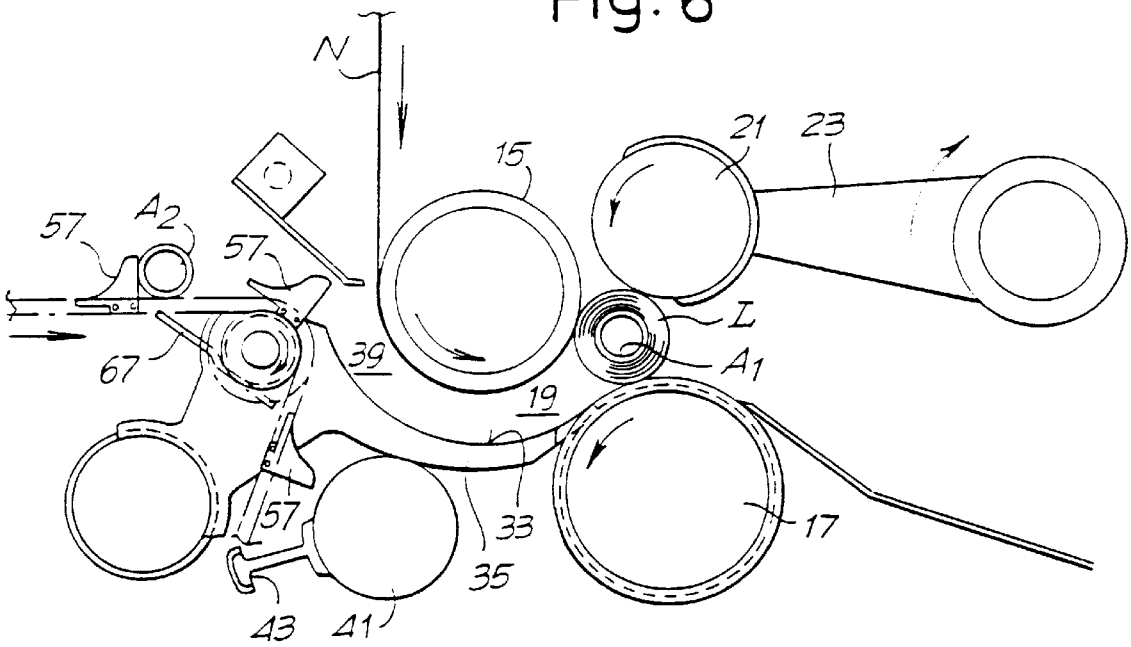
Figure 7:
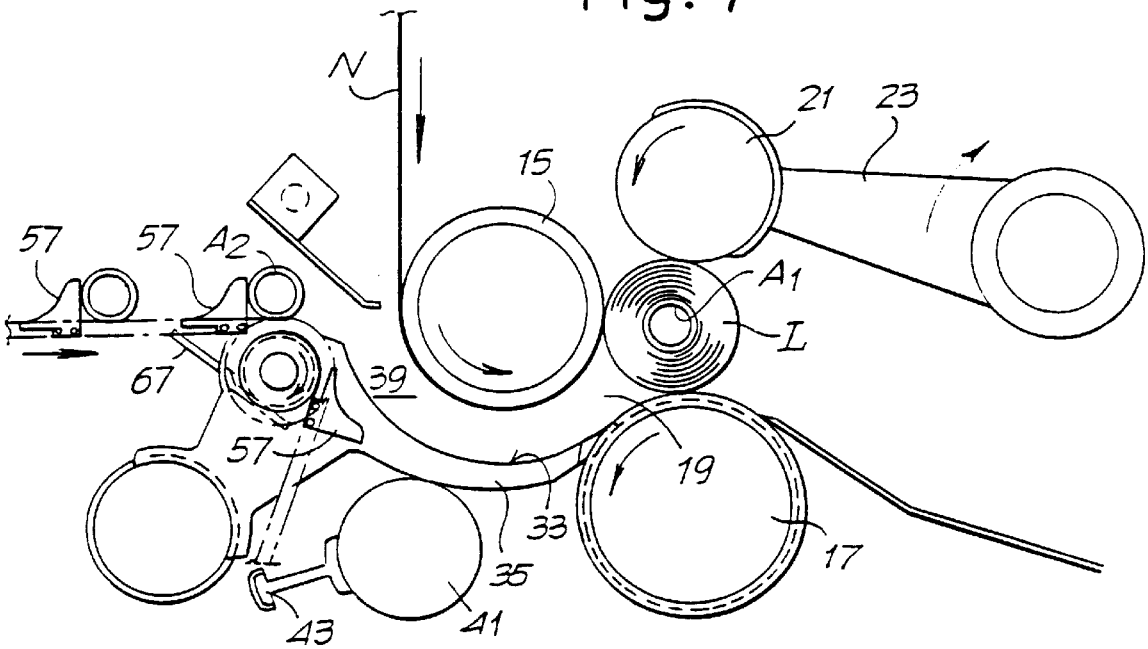

FIGS. 2 to 8 show different successive operating phases during a winding cycle. In FIG. 2, the roll L is virtually completely wound between the rollers 15, 17, 21 and is on the point of being discharged. A new core A1 is inserted by the feeder 67 into the channel 39. In this phase, the core Al is abruptly accelerated angularly and it goes from a zero angular speed to such an angular speed that the point of contact with the roller 15 moves at the peripheral speed of the roller 15 itself (typically 400–700 m/min and above) and its centre advances at a speed equal to half rolling on the surface 33. Notwithstanding the limited inertia of the core, its angular and linear acceleration inevitably involves an initial sliding of the core itself in relation to the band-shaped material and therefore a dephasing (not exactly estimatable) of the position of the core in relation to the position of the band-shaped material.

The second winding roller 17 is decelerated temporarily to remove the completed roll L from the winding zone.

The operations of insertion of the core by means of the feeder 67 and of deceleration of the roller 17 are synchronized with the position of the lines of perforation of the band-shaped material obtained by means of the perforator 5.

Daring the advance of the core Al along the channel 39, the band-shaped material is torn or cut by the means 43 in the manner described in WO 94/21545 (FIG. 3), and the band-shaped material starts to be wound onto the new core Al (FIG. 4), while the completed roll L is discharged through the action of the difference in speed between the roller 21 and the roller 17 which has been decelerated.

When the core Al enters into contact with the lower winding roller (FIG. 5), it undergoes a new abrupt variation in angular velocity. In fact, it has to assume such a velocity that the point of contact with the first winding roller 15 is still equal to the feed speed of the band-shaped material, while the speed of the point of contact with the second winding roller 17 has to pass from zero (speed which the point of contact of the core with the fixed surface 33 had) to the peripheral speed of the second winding roller 17, typically equal to approximately 10% less than the peripheral speed of the first winding roller 15. This abrupt variation in speed may again lead to a,, sliding with consequent further loss of phase between the position of the core and the angular position of the winding rollers.

The passage of the core through the throat 19 takes place through the ection of the difference in speed between the rollers 15 and 17. This difference in speed has to be reduced gradually until it is eliminated or in any case brought to very limited values to continue the winding of the roll between the three rollers 15, 17, 21 (FIGS. 6 and 7) to avoid sliding between roll and surface of the winding rollers. The re-acceleration gradient of the second winding roller 17 has to be delayed in such a manner that the core leaves the throat 19 at the correct moment, that is to say when it can enter into contact with the third winding roller 21.

To guarantee that the start of the re-acceleration gradient of the second winding roller 17 is correctly synchronized with the position of the core, a sensor is provided which is diagrammatically indicated by 90. The sensor, comprising an emitter and a receiver arranged on the two sides of the throat 19, detects the passage of the core Al (FIG. 5) and emits a corresponding signal. This is sent to a programmable central control unit 92 which manages the functioning cycle of the machine and which also orders the start of the re-acceleration gradient of the roller 17, if appropriate after a given programmable delay. The same central contol unit 92 is connected to an encoder associated with the perforator 5 to synchronize the start of the operations of insertion of the core and deceleration of the roller 17 with the position of the lines of perforation on the band-shaped material N, in a manner known per se.

When the winding of the roll on the core Al has been completed, the cycle is repeated with the insertion of a new core (FIG. 8).

FIG. 9 illustrates by way of indication a diagram which shows on the x-axis the quantity of band-shaped material which passes and on the y-axis the difference in percentage between the peripheral speed of the second winding roller 17 and the peripheral speed of the first winding roller 15 and of the band-shaped material N. At the moment t1, the central unit starts the procedure of deceleration of the second winding roller 17. The deceleration gradient Rd is typically linear and ends at the moment t2. At a moment t3, the core A, which has previously been inserted into the channel 39, enters into contact with the second winding roller 17. The position of this moment along the x-axis is uncertain because of the sliding of the core in the phase of insertion into the channel 39. The second winding roller 17 is kept at the lower speed of rotation until a moment t4, at which point the re-acceleration gradient Ra constituted by a practically asymptotic curve starts. The moment t4 is determined exactly according to the position of the core detected by the sensor 90.

The signal emitted by the sensor 90 can be utilized, instead of for determining the start of the re-acceleration gradient of the second winding roller, for modifying the shape of the re-acceleration curve. FIG. 10 shows a similar diagram to FIG. 9, in which the moment t4 is fixed, that is to say the re-acceleration gradient Ra of the second winding roller starts after a fixed quantity of band-shaped material has passed. The moment t5 is the moment of emission of the signal by the sensor 90. Until this moment, the portion of curve Ra has a constant shape. From this point, the curve Ra can have a more or less sloping shape according to the necessity of re-accelerating the core more or less rapidly to maintain good control of its movement. The portion of curve Ra1 relates to a situation in which the core is late in relation to the theoretical position and a longer deceleration is therefore maintained to allow the correct advance of the core. The portion Ra2 relates to a situation in which the core is early and therefore has to be brought forward with less promptness.

This does not exclude a combination of the two methods of control, if appropriate with the use of more than one sensor.

It is intended that the drawing shows only an exemplification given only by way of practical demonstration of the invention, it being possible for this invention to vary in form and arrangement without, however, leaving the scope of the concept which forms the invention itself. Any presence of reference numbers in the attached claims has the purpose of facilitating reading of the claims with reference to the description and to the drawing, and does not limit the scope of the protection represented by the claims.

I claim:

1. Peripheral re-reeling machine for producing rolls of wound band-shaped material, comprising:

a first winding roller around which a band-shaped material to be wound is guided;

a second winding roller, there being defined between said first and said second winding roller a throat into which winding cores are introduced in succession;

feeder apparatus for introducing the winding cores into said throat;

and control apparatus for bringing about, at completion of winding of each roll, variation in at least one aspect of winding for controlling advance of a new core through said throat, wherein a sensor is associated with said throat, said sensor detecting passage of a core at a predetermined point and emitting a signal upon the passage of said core, with cyclical functional variation of the at least one aspect of winding occurring based on said signal.

2. Re-reeling machine according to claim 1 wherein said cyclical functional variation comprises deceleration and successive re-acceleration of the second winding roller.

3. Re-reeling machine according to claim 2 wherein a re-acceleration gradient of the second winding roller is determined by said signal.

4. Re-reeling machine according to claim 2 or 3 wherein said signal determines start of re-acceleration of said second winding roller.

5. Re-reeling machine according to claim 4 wherein said control apparatus orders the start of the re-acceleration of the second winding roller with a delay which is predeterminable in relation to the signal of said sensor.

6. Re-reeling machine according to claim 1 wherein said second winding roller is movable in relation to the first winding roller to vary a dimension of said throat during the passage of a core through the throat, and wherein relative movement between said first and said second roller is controlled according to said signal.

7. Re-reeling machine according to claim 1 wherein said sensor is an optical sensor including an emitter and a receiver arranged on opposite sides of said throat and aligned transversely in relation to a direction of advance of the core.

8. Re-reeling machine according to claim 1 further comprising a third winding roller arranged downstream of said throat, said third winding roller being movable to allow growth in diameter of a roll being formed and ejection of a formed roll.

9. Re-reeling machine according to claim 1 wherein position of said sensor in relation to said throat is adjustable.

10. Method for producing rolls of band-shaped material wound on winding cores comprising:

providing a first winding roller around which a band-shaped material is guided;

providing a second winding roller, a throat being defined between the first and the second winding roller for passage of a winding core;

upon completion of winding of each roll, varying temporarily at least one aspect of winding to control advancement of a new winding core through said throat, wherein passage of said new winding core from a predetermined position is detected and a signal is generated upon said passage, and variation of the at least one aspect of winding occurs based on said signal.

11. Method according to claim 10 wherein the second winding roller is decelerated upon completion of the winding of each roll to allow the passage of the core through said throat and said second winding roller is then re-accelerated to operating speed, with re-acceleration being controlled according to said signal.

12. Method according to claim 11 wherein a curve representing said re-acceleration is modified based on said signal.

13. Method according to claim 11 or 12 wherein said re-acceleration is started based on said signal.

14. Method according to claim 13 wherein start of the re-acceleration of said second winding roller is delayed by a predeterminable period of time in relation to the passage of said core from said predetermined position.

15. Method according to claim 10 wherein a dimension of said throat is variable upon passage of each core through said throat, with relative movement between the first and the second winding roller being phased with said signal.

16. Method according to claim 10 wherein the passage of the core from said predetermined position is detected optically.

17. Method for peripheral winding of rolls of web material on winding cores in a winding cradle, wherein a roll of web material is wound on a core in said winding cradle, the roll, upon completion of winding of web material on said roll, is discharged from the winding cradle and a new core is inserted in the winding cradle by temporarily varying at least one aspect of winding, wherein detection of passage of said new core from a predetermined position and provision of variation of said at least one aspect of winding is according to said passage.

18. A peripheral winding machine, including a winding cradle in which rolls of web material are formed in succession on respective winding cores, and including apparatus for introducing said cores into said cradle, with at least one aspect of winding being cyclically and temporarily varied for introducing a respective new core into said cradle, wherein a sensor is present which detects passage of the core being inserted into said cradle at a predetermined point and emits a signal upon the passage of said core, with variation of the at least one aspect of winding occurring based on said signal.

* * * * *